US005258046A

United States Patent [19]

Haga et al.

[11] Patent Number: 5,258,046

[45] Date of Patent: Nov. 2, 1993

[54] SCROLL-TYPE FLUID MACHINERY WITH SEALS FOR THE DISCHARGE PORT AND WRAPS

[75] Inventors: Shuji Haga; Masatomo Tanuma, both of Yokohama; Takashi Serita, Tokyo, all of Japan

[73] Assignee: Iwata Air Compressor Mfg. Co., Ltd., Tokyo, Japan

[21] Appl. No.: 903,463

[22] Filed: Jun. 24, 1992

Related U.S. Application Data

[63] Continuation-in-part of Ser. No. 654,184, Feb. 13, 1991, Pat. No. 5,145,344.

[30] Foreign Application Priority Data

Jun. 26, 1991 [JP] Japan ..... 3-250173
Jun. 29, 1991 [JP] Japan ..... 3-185532

[51] Int. Cl.[5] ..... F01C 1/04; F01C 19/08; F01C 21/02

[52] U.S. Cl. ..... 418/55.2; 418/55.3; 418/55.4; 418/60; 418/142

[58] Field of Search ..... 418/55.2, 55.3, 55.4, 418/60, 142

[56] References Cited

U.S. PATENT DOCUMENTS 3,994,635 11/1976 McCullough ..... 418/55.4
4,157,234 6/1979 Weaver et al. ..... 418/55.2
4,730,375 3/1988 Nakamura et al. ..... 418/55.4
4,883,413 11/1989 Perevuznik et al. ..... 418/55.4

FOREIGN PATENT DOCUMENTS 0298315 1/1989 European Pat. Off. .
2160582 6/1973 Fed. Rep. of Germany ..... 418/55.2
3538522 12/1986 Fed. Rep. of Germany .
63-42081 8/1988 Japan .
1-167482 7/1989 Japan ..... 418/60
2-140482 5/1990 Japan ..... 418/55.3
3-138472 6/1991 Japan ..... 418/55.3
1373873 2/1988 U.S.S.R. ..... 418/55.2

*Primary Examiner*—John J. Vrablik
*Attorney, Agent, or Firm*—Evenson, McKeown, Edwards & Lenahan

[57] ABSTRACT

The present invention is intended to provide an oilless scroll-type compressor which can obtain a high compression efficiency with highly accurate sealability retained and particularly has such a constitution that a chip seal fitted in each of the wrap end surfaces of stationary scrolls and an orbiting scroll is integrated with a backup seal, a discharge port in communication with a wrap groove terminal end through a through-hole is formed in a land section positioned on the interior side of a wrap inner circumferential end on the side of one scroll and situated around a shaft hole through which a main shaft is inserted, and the circumference of said discharge port is surrounded by the chip seal extended from said wrap.

9 Claims, 6 Drawing Sheets

SCROLL-TYPE FLUID MACHINERY WITH SEALS FOR THE DISCHARGE PORT AND WRAPS

This application is a continuation-in-part of co-pending application Ser. No. 07/654,184 filed Feb. 13, 1991, Pat. No. 5,145,344.

BACKGROUND OF THE INVENTION

1. Field of the Invention

This invention relates to a scroll-type fluid machine that functions as a compressor, and more particularly to an oilless scroll-type fluid machine wherein a chip seal is fitted into a seal groove that is rectangular in cross-section and formed in a helical wrap end surface which is opposed to a slide surface of an associated scroll so that the surrounded space between said slide surface and the wrap is sealed with the chip seal.

2. Description of the Prior Art

Scroll-type compressors which are known in the art include a stationary scroll having a first wrap formed in an involute spiral located within a casing enclosed by circumferential walls, a suction port and a discharge port formed in the circumferential wall and in the central region respectively, and an orbiting scroll having a second wrap formed in an involute spiral capable of mating with the first wrap, wherein the orbiting scroll is orbited without spinning to introduce a gas into the casing from the suction port and to take the gas into a closed space formed between the first wrap and the second wrap, as the orbiting scroll is orbited. The volume of the gas is gradually reduced with the gas being moved toward the center, and the thus compressed high-pressure air can be discharged outside from the discharge port.

The above scroll-type fluid machine can be a single unit scroll-type machine for expanding, compressing, or pumping fluid with a stationery scroll and an orbiting scroll interfitting each other, as disclosed, for example, in U.S. Pat. No. 4,192,152 and a twin unit scroll-type machine for expanding, compressing, or pumping fluid utilizing a pair of stationary scrolls having respectively a wrap inside and an orbiting scroll having a wrap on both surfaces which are interfitted with the stationary scrolls as suggested in Japanese Patent Publication 63-42081.

However, in either of the above scroll-type fluid machines, since the wraps of the scrolls have approximately the same number of turns and are mated with each other with the phase displaced 180 degrees, problems described below arise at the suction side as well as the discharge side.

That is, on the suction side, the wrap starting ends situated on the scroll outer circumferential side come in contact with the other wrap side wall surface at the position where the phases are displaced 180 degrees to form a compression chamber, and therefore it is necessary that a suction port is formed at each wrap starting end position, or a semicircular detour in communication with the suction port positioned 180 degrees away is formed on the wrap outer circumferential side, resulting in that the apparatus is made large and the number of steps of producing it increases.

The arrangement of a number of suction ports as described above means that a number of compression chambers with the phases displaced 180 degrees carry out simultaneously the compression step, which makes difficult the high compression, and small the volume of the gas to be taken into the closed space enclosed by the wraps, so that the suction efficiency is not improved.

On the other hand, on the discharge side, since it is necessary to arrange a bearing section where a main shaft (crank shaft) is inserted so as to orbit the orbiting scroll at the central part of the scroll, a wrap terminal end and a discharge port must be disposed on the bearing section outer circumferential side in the involute spiral, and the arrangement of the wrap starting ends with the phases displaced 180 degrees makes short the involute spiral that can form a closed space (compression chamber), which results in that the volume of the final compression chamber remains large to be opened to the discharge port and therefore the compression ratio becomes small.

The large volume of the final compression chamber makes the seal line longer and as a result the sealability lowers and leakage is liable to occur, thereby lowering the compression efficiency.

To solve the above problems, in the so-called single unit scroll-type fluid machine, a main shaft of the orbiting scroll is disposed on the wrap back side so that a discharge port is arranged at the stationary scroll central section, while in the twin unit scroll-type fluid machine, as shown in the embodiment below, since an orbiting scroll is disposed between a pair of stationary scrolls, a main shaft must be extended through the stationary scroll central section, and therefore a defect inevitably arises that a wrap terminal end and a discharge port have to be disposed on the bearing section outer circumferential side in the middle of the involute spiral in the fluid machine adopting the above constitution.

Particularly in a compressor out of these fluid machines, in order to obtain a clean compressed gas, a groove section is formed in a wrap end surface opposed to the associated scroll specular surface and a self-lubricating seal member (hereinafter referred to as chip seal) is fitted into said groove section, thereby an oilless compressor is suggested wherein the wrap end surface is allowed to come slidably in contact with the associated scroll not directly but through said chip seal so that oilless sealing becomes possible without using an oil seal (see, for example, German Patent DE No. 3,538,522).

However, in a twin unit scroll-type fluid machine, since a bearing section wherein a rotating shaft and others are inserted is situated at the scroll central section, a wrap terminal end and a discharge port are required to be disposed halfway of the helical curve on the bearing section outer circumferential side and in this state the wraps of the scrolls are mated with each other with the numbers of the turns being the same and with the phases being displaced 180 degrees.

Therefore, the gas is released to the discharge port while the volume of the final compressed chamber remains large on the discharge side, so that the compression ratio becomes small.

Further, since the large volume of the final compression chamber makes the seal line longer, the sealability lowers and a backward flow is liable to occur, leading to lowering of the compression efficiency.

In the scroll-type fluid machine using the chip seal, as shown in the above-mentioned German Patent and EPC patent No. 029,8315, a resilient backup member is disposed in the interior of the groove section on the chip seal back side and a floating effect is increased through the backup member to increase the sealing effect.

However, the chip seal groove is not easily made deeper, since the machining tools have a limit and the number of steps of cutting required for making the groove deeper increases.

Further, if the groove is too deep, when the wraps are orbited, a force is exerted transversely of the chip by the sliding engagement with the scroll specular surface, and a collapse will occur, which is unfavorable in view of the strength. If the width of the wrap is increased to solve this problem, the width of the wrap does not contribute to the compression efficiency at all, and problems arise in that a dead space increases and the compression efficiency and the amount of the air decrease.

Therefore, a backup member is disposed in the interior of the groove section on the chip seal back side without making the groove of the chip seal deep and the chip seal upper section is extended out of the groove section. However in that configuration, the amount of the chip seal in the groove decreases and the chip seal is subjected to an energized force due to the small spring constant of the backup member, resulting in a problem in that the assembly of the chip seal becomes impossible because the chip seal attached in an involute fashion is disengaged from the seal groove unless the assembly is carried out very carefully.

SUMMARY OF THE INVENTION

Object of the Invention

The present invention overcomes the above various defects of a twin unit scroll-type compressor and makes the twin unit scroll-type compressor easily usable in practice.

Another object of the present invention is to provide a very small scroll-type fluid machine which can improve the suction/discharge efficiency, and can attain a high compression ratio.

Another object of the present invention is to provide a scroll-type fluid machine which improves the sealability between wraps and the compression ratio or expansion ratio.

Another object of the present invention is to provide a twin unit scroll-type fluid machine wherein the assembly tolerances and the machining tolerances of the scrolls are not required as critical as in the conventional devices, and if there is a mechanical error, the error can be absorbed, and the sealability between the wrap end surface and the associated specular surface can be kept to obtain a desired compression ratio or expansion ratio.

A still another object of the present invention is to provide a scroll-type fluid machine having a resilient backup member disposed in the interior of a groove section on the chip seal back side, wherein the above problems associated with the assembly of the scroll, as described above, can be easily overcome.

The above objects are met by the following described embodiment of the invention.

The present invention relates particularly to an oilless scroll-type fluid machine of the twin unit scroll compressor type having an orbiting scroll and a pair of stationary scrolls positioned on the opposite sides of the orbiting scroll. A chip seal is fitted into a seal groove which is rectangular in cross section and formed in a helical wrap end surface opposed to a slide surface of an associated scroll. A surrounded space between the slide surface and the wrap is sealed with the chip seal.

The stationary scroll has a central shaft hole through which a main shaft is inserted to allow the orbiting scroll to be orbited, a discharge port is formed in a land section surrounding the central shaft hole, and the discharge port communicates with an inner circumferential end of an involute groove region (an involute groove region between the wrap and the land section outer circumference) positioned on the land section circumferential side through a through-hole, formed in the land. A seal groove extends from the wrap inner circumferential end on the upper surface side of the land section and the discharge port and the involute groove region inner circumferential end are sealed with a chip seal fitted in the seal groove.

That is, where the present invention is to be applied to a compressor, as shown in FIG. 6, without causing a wrap inner circumferential end 15*a* of an orbiting scroll 1 to face to a discharge port 7, a discharge port 7 is formed through a through-hole 31 in a land section 4 of a central shaft hole 1*a* situated in the interior of an inner circumferential end 21*a* of the scroll groove 21, so that when the volume of the final compression chamber becomes the smallest, the discharge is carried out, and therefore the compression efficiency is improved.

As described above, the attained small volume of the final compression chamber makes the seal line short, and as a result the sealability is improved and the backward flow can be prevented, so that the compression efficiency is further improved.

In this case, when the discharge port 7 and the involute groove region inner circumferential end 21*a* are in communication through the land section 4, if the discharge port 7 is disposed on the side of the land 4 as described above, the air-tightness will fail between them and the above-mentioned objects cannot be attained fully.

Therefore, in the present invention, the discharge port 7 and the involute groove region 21*a* are made in communication through the through-hole 31, a seal groove 90*b* extended from the wrap inner circumferential end is formed on the upper surface side of the land section 4 where the through-hole 31 is drilled, and the discharge port 7 and the inner circumferential end of the involute groove region 21*a* are sealed with the chip seal 9*b* fitted in the seal groove 90*b*.

According to the above technique, the gas highly compressed by the involute groove region inner circumferential end 21*a* can be prevented from leaking along the upper surface of the land section 4 to the discharge port 7, and accordingly the discharge efficiency can be improved and the compression ratio can be increased.

In this case, if the seal groove 90*b* is extended to allow all the circumference of the central shaft hole formed in the land section 4 to be surrounded by the seal groove 90 and the central shaft hole, the discharge port 7, and the involute groove region inner circumferential end 21*a* are made sealable with the chip seals 9 to 9*d* inserted into the seal groove 90. Even when a seal means is used in the bearing 65 fitted in the central shaft hole 6, the highly compressed gas can be prevented from leaking along the shaft hole 6 and the above effect can be further enhanced.

In this case, by opening the through-hole 31 at a position nearer to the inside displaced from the central involute of the involute groove region 21*a* (on the land section outer circumferential side), the discharge port 7 and the involute groove region 21 can favorably be made in communication at a position where the gas is compressed most highly.

As shown in FIG. 7, the through-hole 31 is indeed required to be positioned below the seal groove 90b with it being out of communication therewith.

Further, the chip seal 9 used in the present invention is formed by integrating several different beltlike members one on the other without interposing a backup member therebetween on the back side and it is recommended that the member positioned in the interior of the seal groove is formed of a resilient member 91 and the member positioned on the upper side thereof is formed of a self-lubricating member 92.

Thus, if the chip seal groove 901 is not made deep, the assembling of the chip seal 9 is made easy and since the backup member and the chip seal are integrated, a fear is obviated that the ship seal will be displaced if the width of the chip grove is made narrow, further the fact that the width of the chip can be made narrow, which does not contribute to the compression efficiency, leads to the lowering of the dead space, and therefore the compression efficiency and the amount of the air can be further increased.

Further, in accordance with a preferred embodiment, as shown in FIG. 5, even on the discharge side, by extending the wrap inner circumferential end 10a on the side of the stationary scroll 1 toward the inner circumferential end by half a turn in comparison with the wrap inner circumferential end 15a on the side of the orbiting scroll 2, the inner circumferential ends 10a and 15a of the wraps are made approximately to coincide at a prescribed position of the phases upon the orbiting movement of the orbiting scroll 1, so that the volume of the final compression chamber can be made smallest and correspondingly the discharge efficiency can be improved and the compression ratio can be increased.

In this case, by forming the involute groove region inner circumferential end 21a into a semicircle, and allowing the wrap inner circumferential end 15a on the side of the orbiting scroll 1 to slide along the wall surface of the involute groove inner circumferential end 21a, the above-mentioned effect as well as the sealability on the side of the wrap inner circumferential end 15a on the side of the orbiting scroll 1 is improved.

In this case, it is recommended that the radius X of the semicircle of the circumferential wall surface is to be set approximately equal to the eccentricity between the the shaft hole center 1a of the orbiting scroll and the center of the shaft hole 2a of the stationary scroll 2, in other words, approximately equal to the orbiting radius x.

Additionally, although an improvement in the compression efficiency and an increase in the compression ratio can be attained by taking the above constitution, in the case of a twin unit scroll-type fluid machine, unless the retention of the parallelism between the opposed scrolls and the adjustment of the thrust are attained precisely and easily, the practical use thereof is difficult.

Therefore, in the twin unit scroll-type fluid machine in the present invention, as shown in FIG. 1, the orbiting scroll 1 is born on the main shaft 6 movable slightly in the thrust direction in association with the stationary scrolls 2A and 2B. Each of chip seals 9 which are resiliently energized approximately to the same extent is fitted into at least each of the wrap end surfaces 101 and 151 of the orbiting scroll 1 opposed to the specular surfaces 11a and 21a of the stationary scrolls 2A and 2B so that the specular surfaces and the wrap end surfaces 101 and 105 can be sealed with said chip seals. The chip seal is formed by integrating several different beltlike members one on the other, the member positioned in the interior of the seal groove is made of a resilient material, preferably a soft resilient material having a small spring constant, and the member positioned on its upper side is made of a self-lubricating material.

According to the present invention, the orbiting scroll can be moved in the thrust direction, and since the chip seal 9 fitted in each of the wrap surfaces 101 and 151 of the orbiting scroll 1 has an energized resilient force, even if an uneven thrust force is exerted in the orbiting scroll 1 due to an assembling error or a machining error, the position of the orbiting scroll 1 can be automatically corrected by the resilient force and the thrust force can be obviated.

In other words, if there is an assembling error or a machining error, any particular thrust adjustment or parallelism adjustment is not required and the correction of the centering of the orbiting scroll 1 can be automatically effected.

Since the chip seal 9 is extendible (expandable) within the resilient limit, the oscillation of the axis of the orbiting scroll 1 can be easily absorbed.

The orbiting scroll 1 is not supported rigidly in association with the stationary scrolls 2A and 2B but is supported resiliently through the chip seals, so that the axial power is not uselessly increased.

Therefore, according to the present invention, by taking the above constitution, since the wrap circumferential surfaces on the suction side, the discharge side, and the intermediate part between them retain high sealability between them and the associated scrolls highly accurately with a simple constitution and a high compression efficiency can be secured, the present twin unit scroll-type compressor can be used in practice.

The use of the chip seal formed by integrating several different beltlike members one on the other is not restricted to the twin unit type but also can be applied to a scroll-type fluid machine having one orbiting scroll and one stationary scroll. The chip seal can be formed by integrating a resilient member and a self-lubricating member through an adhesive, bonding agent, adsorption, or chemical bonding or by applying a viscous member of a self-lubricating material thickly on the resilient member and solidifying the viscous member to integrate them.

DETAILED DESCRIPTION OF THE PREFERRED EMBODIMENT

Preferably embodiments of the present invention will be illustratively described in detail with reference to the drawings. It is, however, not intended to restrict the scope of the present invention to the dimensions, materials, shapes, relative positions, etc. of the constitutional parts of the disclosed embodiments. Rather, the disclosed embodiments are for illustrative purposes, unless otherwise specified.

Figure 1:
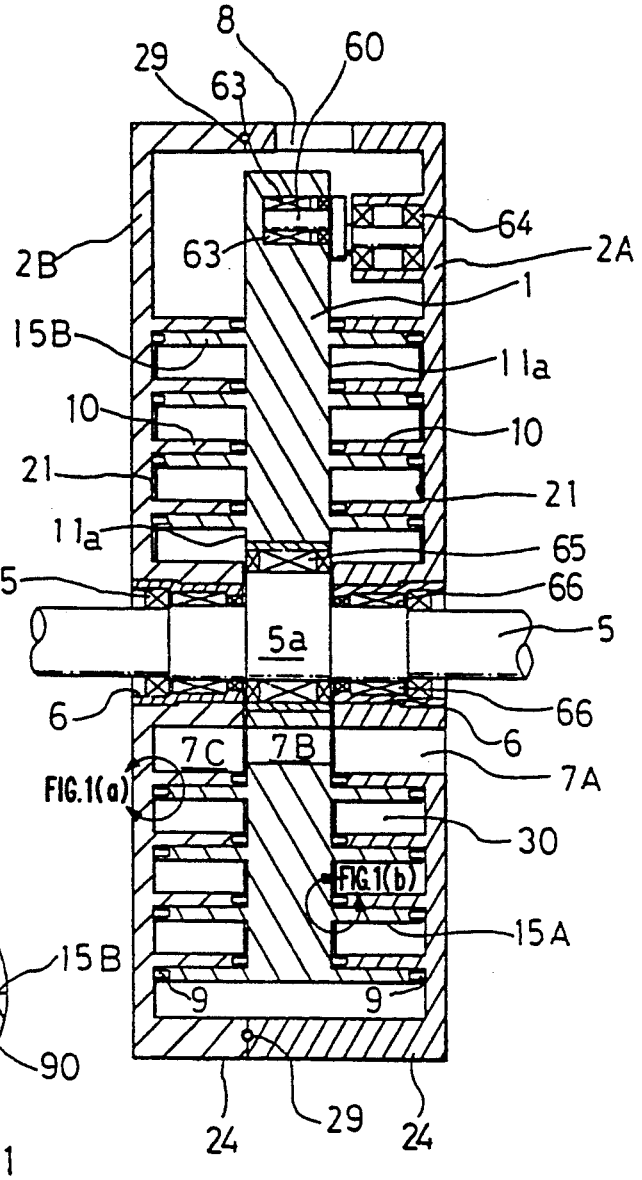
FIG. 1 is an overall sectional view of a scroll-type compressor according to the present invention, wherein (a) and (b) are enlarged sectional views of chip seals.
Figure 1A:
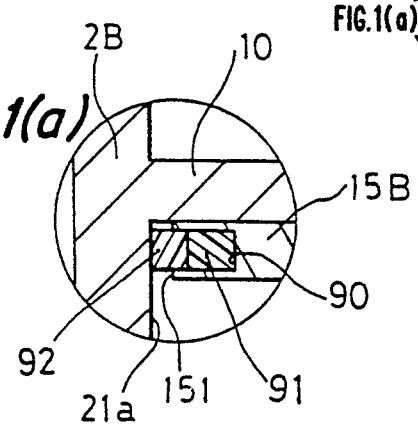
Figure 1B:
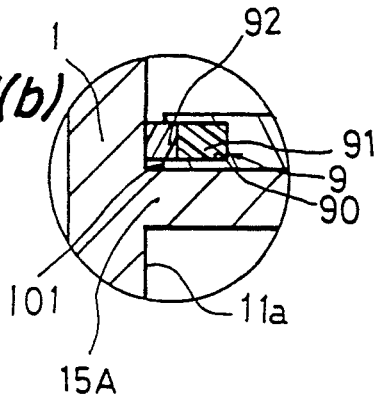
Figure 2:
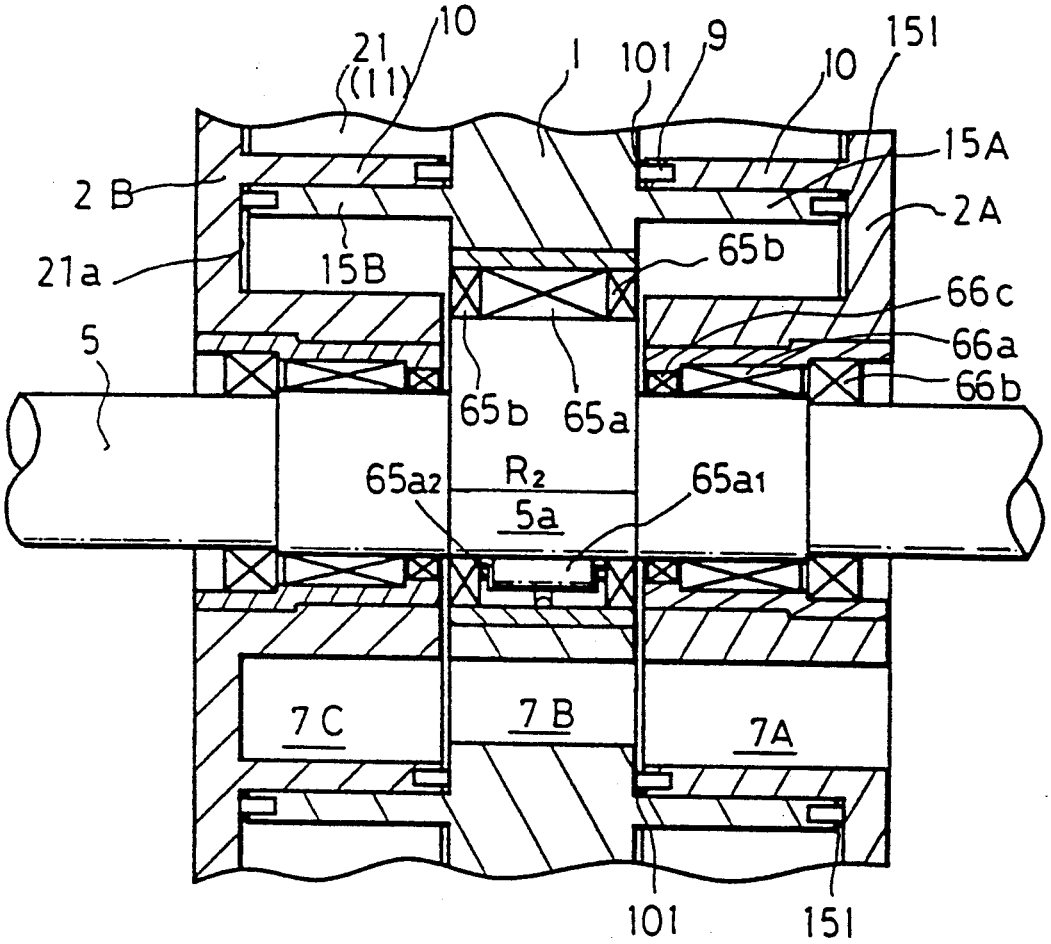
FIG. 2 is an enlarged sectional view of the central shaft section.
Figure 3:
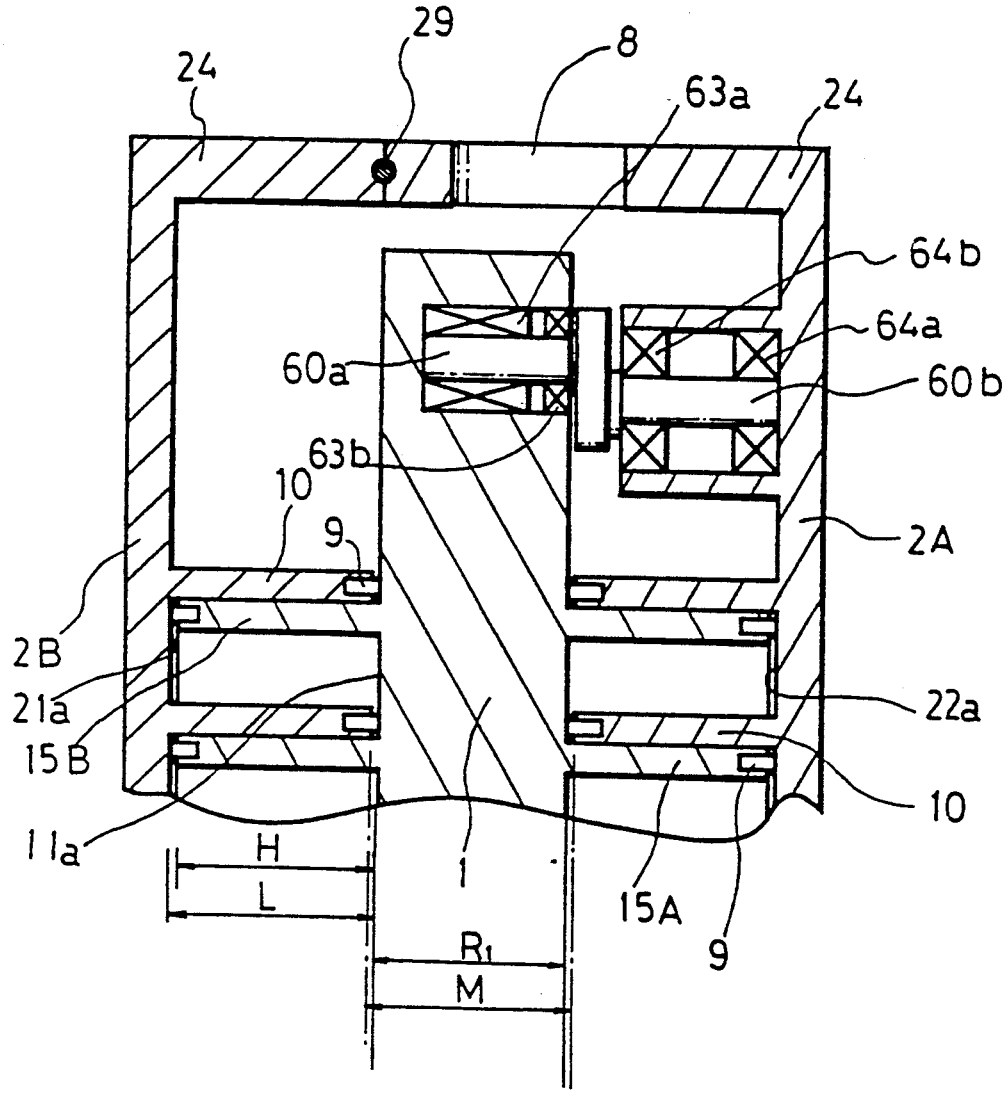
FIG. 3 is an enlarged sectional view of the vicinity of an eccentric rotating shaft.

FIGS. 1 through 3 show an oilless scroll-type compressor of an embodiment according to the present invention which comprises an orbiting scroll 1 provided with a pair of orbiting wraps 15A and 15B at both surfaces axially parallel to a main shaft 5 of which central crank section 5*a* supports the orbiting scroll 1, a pair of stationary scrolls 2A and 2B formed with stationary wraps 10 mated with the orbiting wraps 15A and 15B, and three slave crank shafts 60 for restriction of spin. The slave crank shafts 60 are disposed 120 degrees apart at the outer circumferential sides 24 in a space enclosing the wraps and connect the stationary scroll 2A and the orbiting scroll 1.

The stationary scrolls 2A and 2B are in the shape of, circular caps, their circumferential walls 24 serving as a casing are abutted against each other with a seal member 29 between them so that a closed space may be formed therein and the main shaft 5 is passed through their central shaft holes 4 and through bearings 25 so that the main shaft 5 may be rotatably supported at two sections.

The stationary wraps 10 are helical in shape and are arranged around the bearings 25 and are symmetrically opposed to each other. A discharge port 7A and a suction port 8 are formed in a central region and an outer circumferential edge of the stationary scroll 2A respectively.

The orbiting scroll 1 and the stationary scroll 2B are formed respectively with discharge passages 7B and 7C for leading a compressed gas into the discharge port 7A.

As described above, the opposite surfaces of the orbiting scroll 1 are formed with orbiting wraps 15A and 15B axially parallel to each other, the orbiting wraps 15A and 15B can be mated with the stationary wraps 10, and the support shafts 60*a* of the three slave crank shafts 60 are pivotally supported in a circumferential wall 14 on the circumferential side of the orbiting scroll 1.

That is, as known in the prior art, the slave crank shafts 60 are pivotally supported at positions (3 in number) displaced 120 degrees around the main shaft 5. The support shafts 60*a* of the crank shafts are born in bearings 63 of the orbiting scroll 1 and other support shafts 60*b* are born in bearings 64 of the stationary scroll 2A. As a result, when the main shaft 5 is rotationally driven, the slave crank shafts 60 follow that driven rotation to rotate eccentrically in line with the eccentricity X of the main shaft 5, thereby enabling the orbiting scroll 1 not to rotate on its own axis but to orbit with the fixed radius X about the center of the wraps of the stationary scrolls 2A and 2B.

The slave shafts 60 are born in a cantilever fashion only by the stationary scroll 2A, thereby a slight tilting or axial misalignment of the orbiting scroll 1 can be absorbed to prevent the axial power from a useless increase. The term "axial power" referring to power grains in an axial direction.

That is, if the slave crank shafts 60 are supported by the stationary scrolls 2A and 2B with the orbiting scroll 1 between them, the axial movement of the orbiting scroll 1 can be allowed, but the occurrence of a tilting or axial misalignment of the orbiting scroll 1 cannot be allowed and the orbiting scroll 1 is supported rigidly, unfavorably leading to a problem that results in an increase of the axial power.

Referring to FIGS. 2 and 3, the constitution of the above bearing sections are described. A bearing 65 fitted in the central crank shaft section 5*a* of the main shaft 5 is made up of a known needle roller bearing 65*a* having a number of needle bearings 65*a*1 supported in a housing 65*a*2 and a pair of oil seals 65*b* disposed on the opposite sides of the needle roller bearing 65*a*. The space defined between the oil seals 65*b* is filled with a grease. A bearing 63 between the support shaft 60*a* of each of the slave crank shafts 60 and the orbiting scroll 1 is made up of a housed needle roller bearing 63*a* and oil seals 63*b* and the space defined between the oil seals 65*b* is filled with a grease.

On the other hand, each of the bearings 66 fitted on the main shaft on the stationary scroll side is made up of a sealed angular bearing 66*b*, a housed needle roller bearing 66*a*, and an oil seal 66*c* stated from the outside and its closed space is filled with a grease. A bearing 64 fitted on the support shaft 60*b* of each of the slave crank shafts is made up of a pair of sealed angular bearings 64*a* and 64*b* and its closed space is filled with a grease.

According to the above constitution, the central eccentric shaft 5*a* of the main shaft 5 and the orbiting scroll 1, and the support shaft 60*a* of each of the slave crank shafts 60 and the orbiting scroll 1 are born by the housed needle roller bearings 63*a* and 65*a* wherein a number of the needle bearings 65*a*1 are born in the housing 65*a*2 (the needle bearing 65*a*1 itself has a slight clearance axially in the housing 65*a*2), so that said orbiting scroll 1 is constructed axially movably to a slight extent.

As is shown in FIG. 1, a wrap end surface 101 of each of the stationary wraps 10 opposed to each slide surface 11*a* of the orbiting scroll 1 and an end surface 151 of the slide wrap 15 (15A and 15B) opposed to each slide surface 21 of the stationary scroll 2 (2A and 2B) is recessed to form seal grooves 90 that extend helically along the length of the surfaces and have a rectangular cross-section, and a resilient chip seal 9 of a self-lubricating resin in the shape of a belt is fitted into each of the seal grooves 90 and thus the chip seals 9 are resiliently retained between the slide surface 11*a* of the orbiting scroll 1 and the slide surface 21 of the stationary scroll (2A and 2B).

The height H of each of the wraps is set to be slightly shorter than the distance L between the specular surfaces of the associated scrolls and the distance R1 between the opposite surfaces of the orbiting scroll and the thickness R2 of the central crank section 5*a* of the main shaft are set to be slightly shorter than the distance M between the wrap end surfaces of the stationary scroll. In other words, the opposite surfaces of the orbiting scroll and the wrap end surfaces of the stationary scroll are opposed to have a slight clearance and the wrap end surfaces on the opposite surfaces of the orbiting scroll and specular surfaces of the stationary scrolls are opposed to have a slight clearance. By interposing the chip seals between them, it is made secure that the orbiting scroll 1 can be slightly moved axially and can be resiliently retained.

Figure 7:
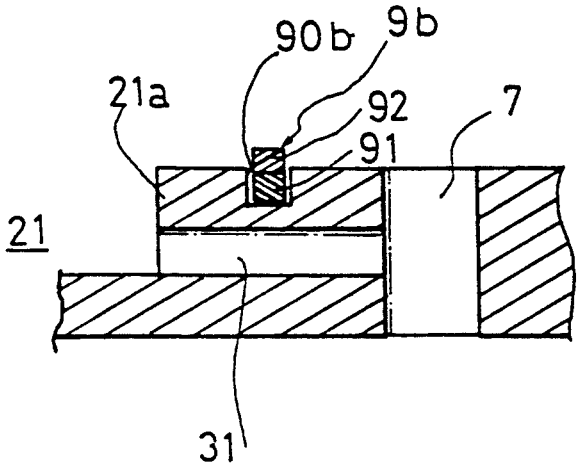
FIG. 7 is a sectional view taken along line 7—7 of FIG. 6.

The chip seals 9 used in this embodiment are not independently placed as backup members as in the above-mentioned prior art, but as is shown in FIGS. 7 and 1, a backup member 91 and a self-lubricating seal member 92 are integrated so that the chip seal 9 itself may be resiliently energized.

The backup member 91 is made from a soft material which has a small spring constant and slightly restores the shape of the backup member 91 when the seal member 92 is forcibly brought in contact with the associated scroll specular surface (slide surface). The soft material can, for example, be a porous material of an ethylene tetrafluoride resin.

The self-lubricating seal member 92 is generally made from a copper containing resin (available under the trade name of Sunflon from Mitsubishi Densen Co.) or a fluororesin, but the present invention is not restricted to these materials.

The backup member 91 and the seal member 92 are in the shape of a belt and are smaller that the seal groove and when they are integrated, the top of the seal member extends out of the seal groove.

Figure 4:
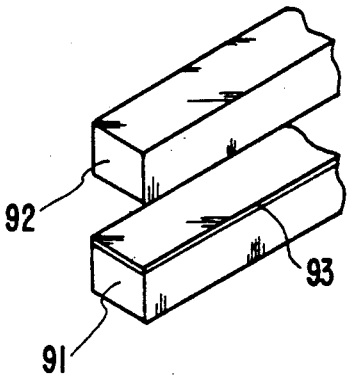
FIGS. 4 (*a*), (*b*), (*c*), and (*d*) are views showing processes of producing chip seals used in the present invention.
Figure 4:
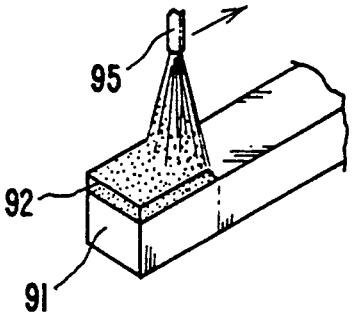
Figure 4:
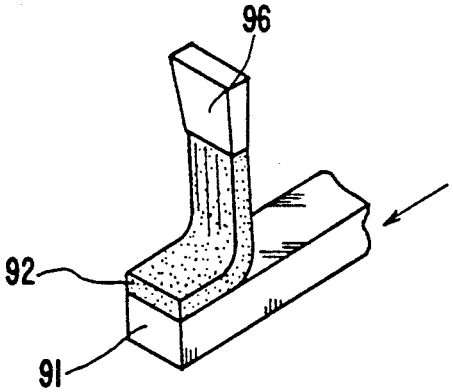
Figure 4:
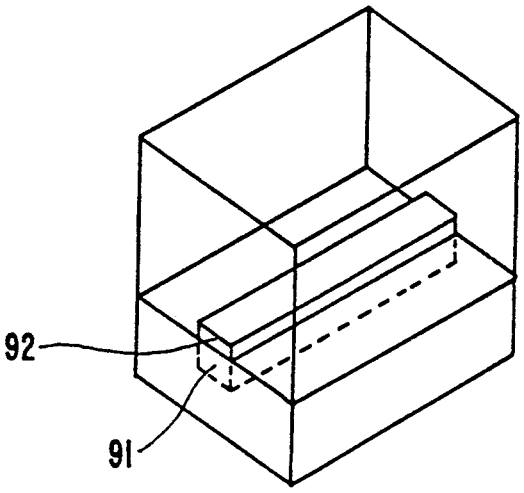

As is shown in FIG. 4(*a*), the upper surface of the backup member 91 and the undersurface of the seal member 92 are integrated by 1) using an adhesive or a bonding agent 93, or 2) as is shown in FIGS. 4(*b*) and (*c*), the seal member 92 which is melted is applied thickly on the upper surface of the backup member 91 by using a spraying machine 95 or a flow coater 96 and then may be solidified thereafter, or 3) as is shown FIG. 4(*d*), the upper surface of the backup member 91 and the undersurface of the seal member 92 may be integrated by a deposition method or chemical bonding.

According to the embodiment, if a nonuniform or unparallel thrust occurs in the orbiting scroll due to an error during the assembly or the machining of the scroll arrangement, the position can be automatically corrected by the resilient force of the chip seals 9, so that such a thrust can be obviated or the parallelism can be adjusted. Moreover since the backup member 91 and the seal member 92 are integrated, the assembly to the seal groove 90 is made easy.

Now, the shape of the wraps used in the embodiment will be described based on FIGS. 5 through 7.

Figure 5A:
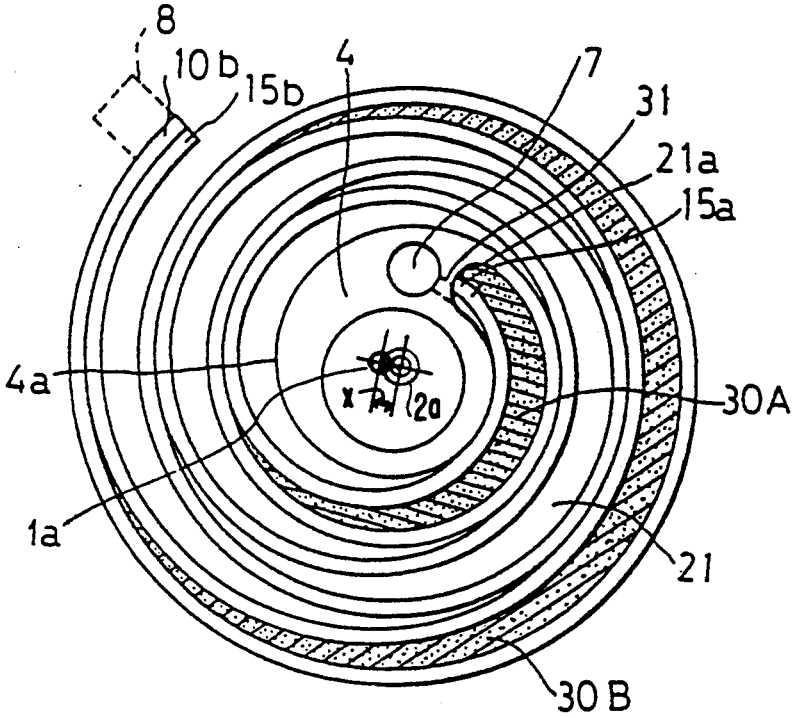
FIG. 5 is schematic views showing the shape and the arranged state of wraps of an embodiment of the present invention with the chip seal omitted, wherein (a) shows the final compression state and (b) shows the intermediate compression state.
Figure 5B:
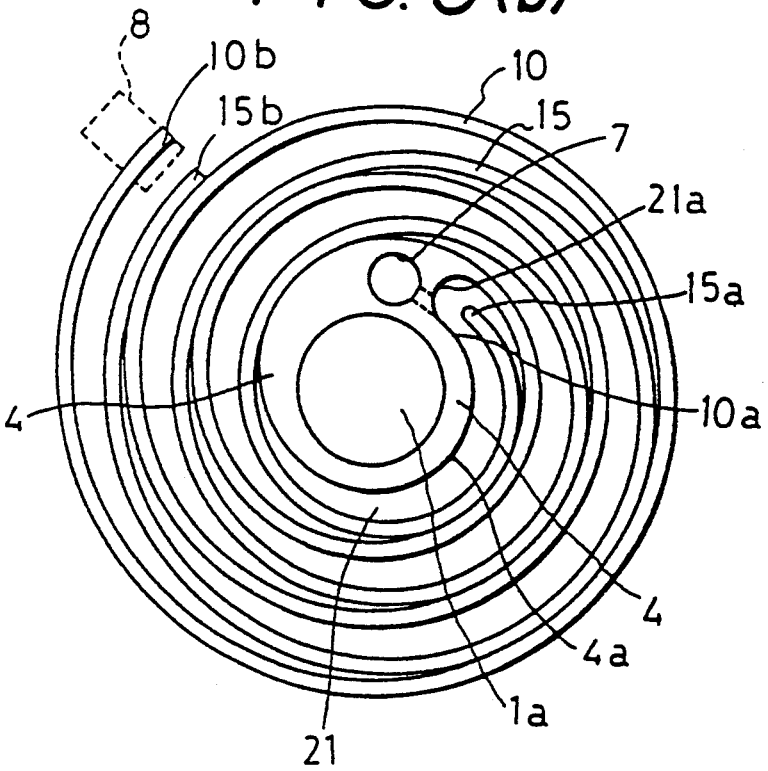

For example, in FIGS. 5(*a*) and (*b*), reference numeral 10 indicates a wrap formed on the stationary scroll 2. The wrap 10 is formed in the shape of an involute starting from an outer circumferential wall 4*a* of a land section 4 and has about $7.5\times\pi$ turns (3.75 turns), and a semicircular wall is formed on the side of an involute groove starting end 21*a* between a second turn wrap 10*c* and a wrap starting end 10*a* formed to the outer circumferential wall 4*a* of the land section.

In this case, the shape of the circumferential wall surface is such that its radius is set to be approximately equal to the eccentricity x between an orbiting scroll shaft 1*a* and a stationary scroll shaft 2*a*, in other words, approximately equal to the scroll orbiting radius.

On the other hand, the wrap 15 on the side of the orbiting scroll 1 is extended in the shape of an involute whose turns are to be about $5.5\times\pi$ turns (2.75 turns) by making shorter by 180 degrees on the inner circumferential end side and on the outer circumferential end side than the wrap 10 on the side of the stationary scroll. The starting end 15*a* is brought in contact with the involute groove circumferential surface so that the wrap starting end 15*a* can be slid along the circumferential surface of the involute groove starting end 21*a* in conformity with the orbiting movement of the orbiting scroll, and the forward end of the wrap starting end 15*a* is formed into a semicircle in cross-section.

The stationary wrap 10 formed on the side of the stationary scroll 2 is formed into a helix having about $5.5\times\pi$ turns (about 2.75 turns) extending from a bearing land sections 4 formed into an involute along the central shaft hole 6 through which the main shaft 5 located at the central section extends and an inner circumferential wall surface 21*a* at the inner circumferential end of a scroll groove 21 between the wrap inner circumferential end 10*a* and the wrap 10*c* positioned on the outer circumferential side of the wrap inner circumferential end 10*a* is formed into a semicircle.

In this case, the shape of the scroll groove inner circumferential wall surface 21*a* is set such that its radius is approximately equal to the eccentricity X between the orbiting scroll shaft hole center 1*a* and the stationary scroll shaft hole center 2*a*, in other words, approximately equal to the orbiting radius.

As a result, when the orbiting scroll 1 is orbited about the stationary scroll shaft hole center 2*a*, the wrap inner circumferential end 15*a* on the side of said orbiting scroll is slid along the scroll groove inner circumferential wall surface 21*a*, so that the smooth sliding movement becomes possible.

As shown in FIG. 7, a discharge port 7 is drilled in the land section 4 on the interior side of the scroll groove inner circumferential wall 21*a* and a through-hole 31 extending through the scroll groove inner circumferential wall surface 21*a* and the discharge port 7 is formed along the direction extended from the outer circumferential wall 4*a* of the land section 4.

According to the above constitution, since the final compression chamber 30A is not opened until the wrap inner circumferential end 15*a* of the orbiting scroll 1 comes near to the land section outer circumferential wall 4*a*, the final compression chamber 30A can be easily reduced, so that the compression efficiency can be improved further.

However, if the chip seal is not interposed on the upper side of the land section 4 between the scroll groove inner circumferential wall surface 21*a* and the discharge port 7, there is a fear that the high-pressure gas in the discharge port 7 will flow back into the final compression chamber 30A that has not yet been fully compressed along the upper surface of the land section 4.

Figure 6:
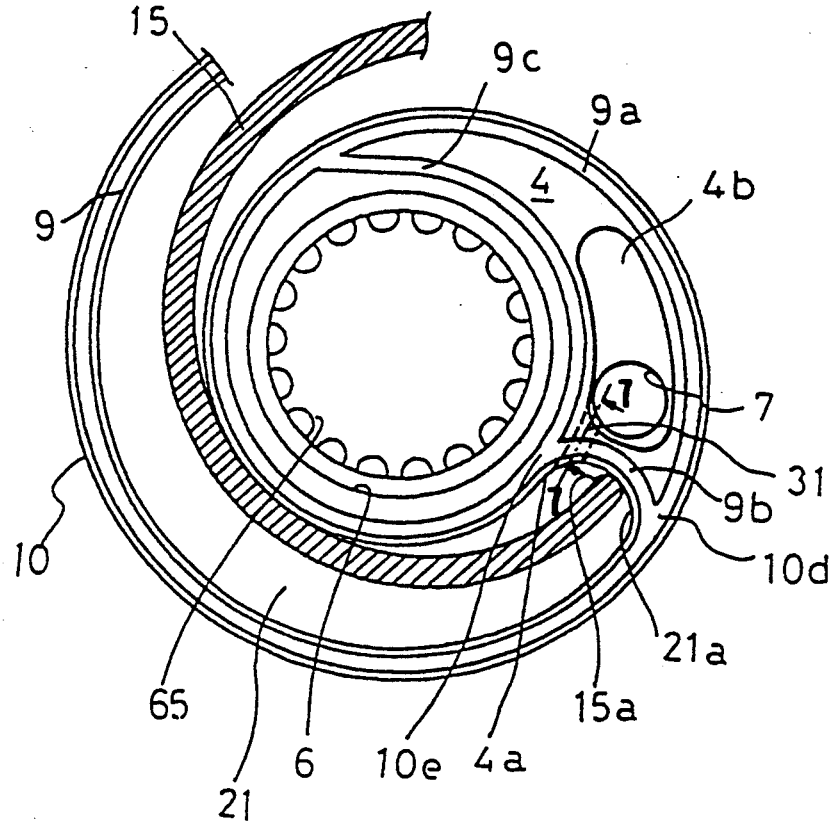
FIG. 6 is an essential view of the central regio of wraps, showing the shape of a chip seal on the side of the stationary scroll.

Therefore, as shown in FIGS. 6 and 7, the chip seal groove 90*b* fitted near to the inner circumferential end 10*d* of the stationary wrap is further increased into a semicircle along the scroll groove inner circumferential wall surface 21*a* of the land section 4 and the chip seal 9*b* is integrated continuously with the chip seal 9 and is fitted into the seal groove.

Although the bearing 65 is inserted in the central shaft hole formed in the land section, if a chip seal is not placed on the upper side of the land section 4 between the shaft hole and the discharge port 7, there is a fear that the high-pressure gas in the discharge port 7 leaks into the central shaft hole along the upper surface of the land section 4.

Therefore, the seal groove is extended so that it can surround the central shaft hole in the land section, and the chip seal 9*c* is fitted into the seal groove such that it is integrally continuous with the chip seal 9 and the chip seal 9b.

In this case, although it is possible that the bearing 66 of the stationary scroll is provided with a seal means capable of prevention of leakage, the chip seal 9c can make up the function of the seal means.

Since the outer circumferential side of the land section 4 functions as a wrap, indeed, the chip seal 9a is fitted integrally and continuously with the chip seals 9, 9b, and 9c into the seal groove. It is desirable that any of the chip seals 9, 9a, 9b, and 9c are press molded integrally.

As a result, the circumference of the discharge port is not directly opposed to the central shaft hole or the involute groove region inner circumferential ends than the land upper surface, but since it is cut off by the chip seals 9a, 9b, and 9c, it is easily made air-tight, and the compression efficiency can be improved further.

Reference symbol 4b indicates a sink to be in communication with the adjacent discharge port 7 (7A, 7B, and 7C).

Consequently, according to the embodiment, the inner circumferential wall surface 21a of the scroll groove 21 is made into the shape of a semicircle, the radius of the semicircle is set to be approximately equal to the eccentricity X between the orbiting scroll shaft hole center 1a and the stationary scroll shaft hole center 2a, in other words, approximately equal to the orbiting radius. Further, the wrap 15 on the side of orbiting scroll 1 is extended, and its inner end 15a can be opposed closely to the scroll groove inner circumferential wall surface 21a or can be slid on it in response to the orbiting movement. Further, since the discharge port 7 is drilled in the land section 4 in the interior of the scroll groove inner circumferential wall surface 21a and the through-hole 31 for making the scroll groove inner circumferential groove wall surface 21a in communication with the discharge port 7 is formed along the outer circumferential wall 4a of the land section 4, the final compression chamber 30A is not opened until the wrap inner terminal end comes near the land section outer circumferential wall 4a, so that the compression efficiency can be improved.

Further, in this embodiment, since the chip seal 9 is disposed to surround the discharge port 7 (7A and 7C) on the side of the stationary scroll 2 (2A and 2B), the backward flow from the discharge port 7 can be prevented completely, and therefore the compression efficiency can be improved further.

Although the above technique was described for stopping the leakage from the discharge port 7 (7A and 7C) on the side of the stationary scroll 2 (2A and 2B), the above technique can be similarly applied to the discharge port 7B on the side of the orbiting scroll 1.

What is claimed is:

1. An oil-free scroll-type fluid machine comprising:

an orbiting scroll having first and second axially projecting involute wraps disposed on respective opposite sides of said orbiting scroll, and first and second slide surfaces respectively disposed between turns of said first and second axially projecting involute wraps;

first and second stationary scrolls each having an involute wrap projecting therefrom which mates with a respective one of said first and second axially projecting involute wraps, a central shaft hole, a land section surrounding said central shaft hole, a discharge port formed in said land section, an involute groove region formed between said involute wrap and an outer circumferential side surface area of said land section, said involute groove region having an inner circumferential end;

a through-hole connecting said discharge port with said inner circumferential end thereby permitting communication between said involute groove region and said discharge port;

a rectangular seal groove formed in an end surface of said involute wrap which is opposed to one of said first and second slide surfaces, said end surface of said involute wrap and said one of said first and second slide surfaces defining an enclosed space therebetween;

a chip seal disposed in said rectangular seal groove to seal said enclosed space; and a rotatable main shaft which orbits said orbiting scroll and which is disposed in said central shaft hole;

wherein said land section has an upper surface area parallel to said end surface, said rectangular seal groove extends into said upper surface between said discharge port and said inner circumferential end, and said chip seal is disposed in and extends throughout said rectangular seal groove.

2. A oil-free scroll-type fluid machine as recited in claim 1, wherein said rectangular seal groove extends in said upper surface of said land section to completely surround said central shaft hole and said chip seal is disposed in the extended portion of said rectangular seal groove thereby surrounding said central shaft hole such that said central shaft hole, said discharge port and said involute groove are sealed from each other by said chip seal.

3. A oil-free scroll-type fluid machine as recited in claim 1, wherein said inner circumferential end is extended by the land section such that a circumferential line of said involute wraps of said first and second stationary scrolls are longer by half a turn from the circumferential line of said first and second axially projecting involute wraps whereby an end portion of said first and second axially projecting involute wraps are approximately in agreement with an end portion one of said involute wraps of said first and second stationary scrolls at a predetermined position of said orbiting scroll.

4. A oil-free scroll-type fluid machine as recited in claim 1, wherein said through-hole is open at a position inward of a central involute line of said involute groove region.

5. A oil-free scroll-type fluid machine as recited in claim 1, wherein said chip seal includes a belt-like resilient member disposed in said rectangular seal groove and a belt-like self-lubricating member disposed on said belt-like resilient member.

6. A oil-free scroll-type fluid machine as recited in claim 1, wherein said first and second axially projecting involute wraps and said involute wraps of said first and second stationary scrolls each have a rap turn of at least 720 degrees.

7. A oil-free scroll-type fluid machine as recited in claim 1, wherein said inner circumferential end has a radius approximately equal to a scroll orbiting radius.

8. A oil-free scroll-type fluid machine as recited in claim 7, wherein said first and second axially projecting wraps each have an inner end portion which slides along said inner circumferential end during orbiting of said orbiting scroll.

9. A scroll-type fluid machine comprising:

a rotatable main shaft having a bearing section;

an orbiting scroll supported on said main shaft and having axially projecting involute wraps projecting from opposite sides thereof, each of said axially projecting involute wraps having an end surface;

a pair of stationary scrolls each having an involute wrap which mate with one of said axially projecting involute wraps of said orbiting scroll and specular surfaces between turns of said involute wrap which oppose said end surfaces of said axially projecting involute wraps;

a plurality of slave cranks which support said stationary scrolls and said orbiting scroll so that said orbiting scroll is orbited without spinning by a rotation of said main shaft;

first needle roller bearings which support said main shaft at said bearing section;

second needle roller bearings which support bearing sections of said slave cranks, thereby allowing said stationary scrolls to be slightly moved in a thrust direction;

a land extending from each of said involute wraps of said stationary scrolls, said land having an upper surface parallel to said end surface and a discharge port formed in said upper surface;

a belt-like chip seal, having a resilient member and a self-lubricating member, resiliently energized to approximately the same extent as the extent of movement of the stationary scrolls in the thrust direction, said chip seal disposed on the end surface of said axially projecting involute wraps and extending along said upper surface between said discharge port and an involute groove region formed between said land and said involute wrap, whereby said specular surfaces and said end surfaces form a space therebetween which is sealed by said chip seal, and said self-lubricating member contacts said specular surfaces.

* * * * *